US005708934A

United States Patent [19]

Nagase et al.

[11] Patent Number: 5,708,934

[45] Date of Patent: Jan. 13, 1998

[54] COLOR IMAGE FORMING APPARATUS WITH WELL-REGISTRATED IMAGEWISE EXPOSURE MEANS

[75] Inventors: Hisayoshi Nagase; Shuta Hamada; Hiroyuki Tokimatsu; Satoshi Haneda, all of Hachioji, Japan

[73] Assignee: Konica Corporation, Tokyo, Japan

[21] Appl. No.: 558,917

[22] Filed: Nov. 13, 1995

[30] Foreign Application Priority Data

Nov. 16, 1994 [JP] Japan ..... 6-282158
Nov. 24, 1994 [JP] Japan ..... 6-289932

[51] Int. Cl.[6] ..... G03G 15/01

[52] U.S. Cl. ..... 399/178; 347/118; 347/138; 399/227

[58] Field of Search ..... 355/326 R, 210, 355/211, 228; 118/645; 399/51, 177, 164, 159, 167, 178, 227; 347/116, 117, 118, 130, 138

[56] References Cited

U.S. PATENT DOCUMENTS

| | | | |
|---|---|---|---|
| 5,541,722 | 7/1996 | Ikeda et al. | 355/326 R |
| 5,557,394 | 9/1996 | Haneda et al. | 118/645 X |
| 5,600,408 | 2/1997 | Horiuchi et al. | 399/51 X |
| 5,608,498 | 3/1997 | Nagase et al. | 399/167 X |
| 5,615,002 | 3/1997 | Haneda et al. | 347/138 X |

FOREIGN PATENT DOCUMENTS 5-307307 11/1993 Japan .

*Primary Examiner*—Shuk Lee
*Attorney, Agent, or Firm*—Frishauf, Holtz, Goodman, Langer & Chick

[57] ABSTRACT

A color image forming apparatus such as a copier or a printer for forming a multicolor toner image. The apparatus includes: a photoreceptor for holding the multicolor toner image; a charger for charging the photoreceptor; plural imagewise exposers each for imagewisely exposing the photoreceptor, which is charged by the charging, with light so as to form a latent image corresponding to a component image of the multicolor toner image on the photoreceptor; a support member for supporting the plural imagewise exposers so that the plural imagewise exposers are fixed on the support member at positions where the light from each of the plural imagewise exposers is focused on the photoreceptor; plural developers each for developing the latent image with one of plural color toners so as to form the component image of the multicolor toner image on the photoreceptor; in which charging of the charging, exposing of the plural imagewise exposers, and developing of the plural developers are performed to form the multicolor toner image on the photoreceptor while the photoreceptor is rotated one time; and a transferor for transferring the multicolor toner image from the photoreceptor to a transfer member.

19 Claims, 13 Drawing Sheets

COLOR IMAGE FORMING APPARATUS WITH WELL-REGISTRATED IMAGEWISE EXPOSURE MEANS

BACKGROUND OF THE INVENTION

This invention relates to a color image forming apparatus through which a color image is formed by superposing a plurality of toner images on the circumference of an image forming member and, particularly, to a digital system color image forming apparatus utilizing an optical exposure system unifying an optical system for serving as an imagewise exposure means and a light source into a body.

The following multicolor image forming apparatuses have been well known so far. Namely, apparatus (A) comprising plural photoreceptors, chargers, developing devices and so forth each as same in numbers as the numbers of colors necessary to form the image, through which the color image is formed by superposing several monochromatic toner images having formed on the respective photoreceptors on an intermediate image transfer member; apparatus (B) through which a color image is formed by plurally rotating a single photoreceptor and then by repeating the charges, imagewise exposures and developments of every separate color; or apparatus (C) through which a color image is formed by carrying out the charges, imagewise exposures and developments of every separate color in serial order within one single rotation of the same single photoreceptor as mentioned in apparatus (B).

However, the above-mentioned apparatus (A) has such a disadvantage that it has to become larger in volume because a plurality of photoreceptors and intermediate image transfer members have to be provided thereto. On the other hand, apparatus (B) has such a limitation that the size of an image formed is restricted to be not larger than the surface area of the photoreceptor, although it may be smaller in volume because only one each of the charging means, imagewise exposure means and photoreceptor is required. From the above-mentioned points, apparatus (C) has such a number of advantages that it has no limitation to any image sizes in spite of a single photoreceptor arranged thereto, and that a high-speed printing operation can be performed.

For apparatus (C), however, it is required that the optical system is to be positioned with a high accuracy so that every plural imagewise exposure means can accurately be coupled to the photoreceptor surface and, at the same time, that an imagewise exposure registration accuracy is to be secured, that is to say, every position of several imagewise exposures to be superposed always accurately and synchronously coincides to an image surface. And, even if any image deformation or displacement should be caused in an imagewise exposure means by a temperature change, it is required to provide a measure for preventing any image displacement caused thereby.

SUMMARY OF THE INVENTION

It is an object of the invention to provide a color image forming apparatus wherein, as the result of solving and improving the above-mentioned problems, an imagewise exposure means can properly be adjusted by a very easy means so as to be in a position corresponding to a photoreceptor surface and a plurality of imagewise exposure means can be kept in the same conditions even if any elongation or shrinkage should be produced by a temperature change and, as the result therefrom, the registration accuracy of every imagewise exposure can be maintained.

The above-mentioned objects of the invention can be achieved by the following color image forming apparatuses.

A color image forming apparatus for repeating a charge, an imagewise exposure and a development within a single rotation of a photoreceptor so that a plurality of the resulting toner images are superposed on the photoreceptor and then for transferring the resulting multicolored toner images collectively to an image transfer member, wherein the above-mentioned plural imagewise exposure means are properly positioned so as to correspond to a common supporting member and are then fixed by an adhesive through a pasting member capable to adjusting the positions of the imagewise exposure means;

a color image forming apparatus for repeating a charge, an imagewise exposure and a development within a single rotation of a photoreceptor so that a plurality of the resulting toner images are superposed on the photoreceptor and then for transferring the resulting multicolored toner images collectively to an image transfer member, wherein a common support member supports the above-mentioned imagewise exposure means in one end each of the means, but not in the other ends thereof;

a color image forming apparatus for repeating a charge, an imagewise exposure and a development within a single rotation of a photoreceptor so that a plurality of the resulting toner images are superposed on the photoreceptor and then for transferring the resulting multicolored toner images collectively to an image transfer member, wherein a common support member supports the above-mentioned imagewise exposure means in the center of the means, but not in the both ends of the means;

a color image forming apparatus for repeating a charge, an imagewise exposure and a development within a single rotation of a photoreceptor so that a plurality of the resulting toner images are superposed on the photoreceptor and then for transferring the resulting multicolored toner images collectively to an image transfer member, wherein the above-mentioned imagewise exposure means are each arranged in a row at regular intervals in the direction of the circumference of a cylindrical or polygonal shaped support member built inside the above-mentioned photoreceptor; and a color image forming apparatus for repeating a charge, an imagewise exposure and a development within a single rotation of a photoreceptor so that a plurality of the resulting toner images are superposed on the photoreceptor and then for transferring the resulting multicolored toner images collectively to an image transfer member, wherein the above-mentioned imagewise exposure means are each arranged to a support member built inside the photoreceptor so that each position of imagewise exposure means can be registrated by the outer circumferential surface of the photoreceptor as the orientation.

DETAILED DESCRIPTION OF THE INVENTION

In advance of the description of each example of the invention, the structures and functions of a color image forming apparatus applicable in common to the invention will be detailed with reference to FIGS. 1 through 4 attached hereto.

Figure 1:
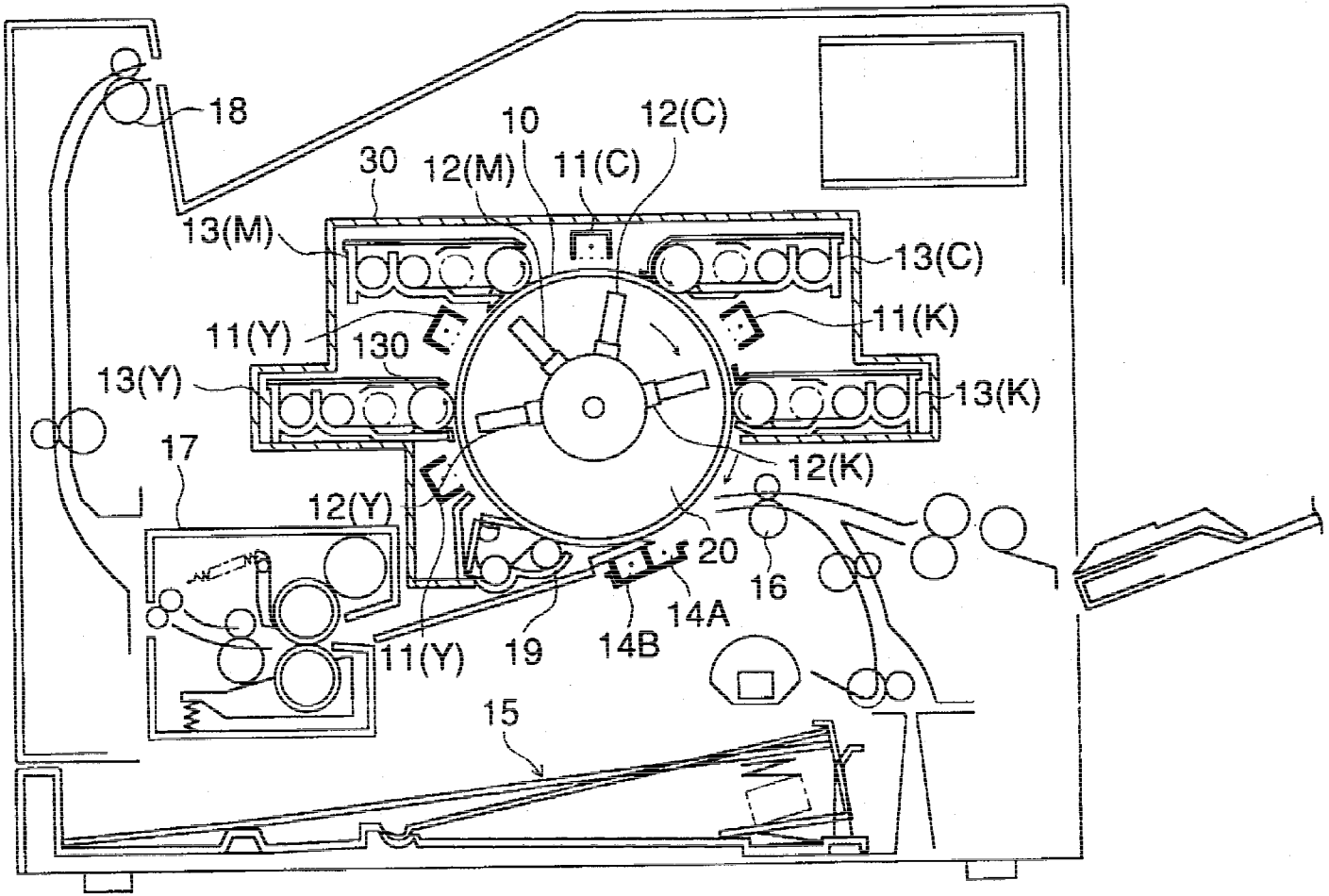
FIG. 1 is a cross-sectional structural view of a color image forming apparatus of the invention.

FIG. 1 shows a color image forming apparatus provided with the so-called built-in type imagewise exposure means having an imagewise exposure means inside a photoreceptor. However, this invention is also applicable to a color image forming apparatus of such a type that an imagewise exposure means is arranged to the outside of a photoreceptor. In the figure, reference numeral 10 is a drum-shaped photoreceptor, that is, a photoreceptor drum, wherein an organic photosensitive layer (or OPC) comprising a transparent conductive layer is coated over the basic circumference formed of such a transparent member as an optical glass or a transparent acrylic resin, and the drum is driven to be rotated clockwise in the electrically grounded state.

Reference numeral 11 is a scorotron charger for a charging means, by which the above-mentioned organic photoreceptive layer of photoreceptor drum 10 is charged grid being kept at a specific potential and then by a corona discharge generated by a discharging wire, so that a uniform potential can be given to photoreceptor drum 10.

Reference numerals 12 are each an optical exposure system, that is, an imagewise exposure means, which is comprised of a Selfoc lens and a light emitting element such as LED, FL, EL and PL that is so arranged as to be in the axial direction of photoreceptor drum 10. Color image signals having been read by a separate image reading device are taken out in serial order from a memory and are then input as electrical signals to the foregoing optical exposure systems 12, respectively. In this example, the light emitting wavelengths of the light emitting elements used therein were within the range of 500 to 900 nm.

The foregoing optical exposure systems 12 are each attached to column-shaped support member 20 and are then loaded inside the main body of the foregoing photoreceptor drum 10. It is also allowed that optical exposure systems 12 may be comprised of the combination of the foregoing light emitting element and, besides, an optical shutter member such as LCD, LISA and PLZT besides and an image focusing lens such as a Selfoc lens.

Reference numerals 13Y, 13M, 13C and 13K are developing devices which are developing means containing a yellow (Y), magenta (M), cyan (C) or black (K) developer. respectively. They are each provided with developing sleeve 130 rotatable in the same direction with a specific gap apart from the circumferential surface of photoreceptor drum 10.

In each of the foregoing developing devices 13, an electrostatic latent image is formed on photoreceptor drum 10 by giving a charge from the foregoing charger 11 and is then reversionally developed in the non-contact state, by applying a development bias voltage.

Now, the process of a color image forming apparatus of the invention will be detailed.

An original document image is read by an image sensor element in an image reading apparatus separate from the present apparatus, or an image is compiled by a computer. The resulting image is the stored once in a memory in the forms of each color image signal in Y, M, C and K.

When starting an image recording, a photoreceptor driving motor is so rotated as to rotate photoreceptor drum 10 clockwise and, at the same time, charger 11 (Y) is then started to apply a potential to photoreceptor drum 10.

After giving the potential to photoreceptor drum 10, an imagewise exposure is started by an electric signal corresponding to the primary color signal, i.e., a yellow (Y) signal, in the foregoing optical exposure system 12 (Y), and an electrostatic latent image corresponding to a yellow (Y image of the original document image is formed on a photoreceptive layer on the drum surface, by the rotary scanning of the drum.

In developing device 13 (Y), the above-mentioned latent image is reversionally developed with a developer on a developing sleeve in the non-contact state, so that a yellow (Y) toner image can be formed as photoreceptor drum 10 is rotated.

Next, to the resulting yellow (Y) toner image formed on photoreceptor drum 10, a potential is further applied by a charge given from charger 11 (M), and an imagewise exposure is carried out by an electric signal corresponding to the secondary color signal of optical exposure system 12 (M), i.e., a magenta (M) image signal. When a non-contact reversional development is carried out in developing device 13 (M), a magenta (M) toner image is successively formed by superposing it over the foregoing yellow (Y) toner image.

In the same process as above, a cyan (C) toner image corresponding to the tertiary color signal is further formed by charger 11 (C), optical exposure system 12 (C) and developing device 13 (C), and a black (K) toner image corresponding to the quaternary color signal is finally formed by charger 11 (K), optical exposure system 12 (K) and developing device 13 (K), so that those toner images are formed by superposing them in serial order. Thus a color toner image is formed on the circumferential surface of photoreceptor drum 10 within a single rotation thereof.

In image transfer device 14A, the resulting color toner image formed on the circumferential surface of photoreceptor drum 10 is transferred to a transfer paper that is a transfer member synchronously fed out of paper feeding cassette 15 by driving timing roller 16.

The transfer paper having received the toner image is separated from the circumferential surface of the drum upon electrically neutralizing the transfer paper by neutralizer 14B. After fusing the toner in fixing device 17, the fixed transfer paper is elected on a tray on the upper side of the apparatus through paper ejecting rollers 18.

On the other hand, after the transfer paper is separated from photoreceptor drum 10, the remaining toner is removed off and photoreceptor drum 10 is cleaned in cleaning device 19 so that the original document toner image formation is kept or, alternatively, the toner image formation is stopped once so as to stand ready for the next original document toner image formation.

Figure 2:
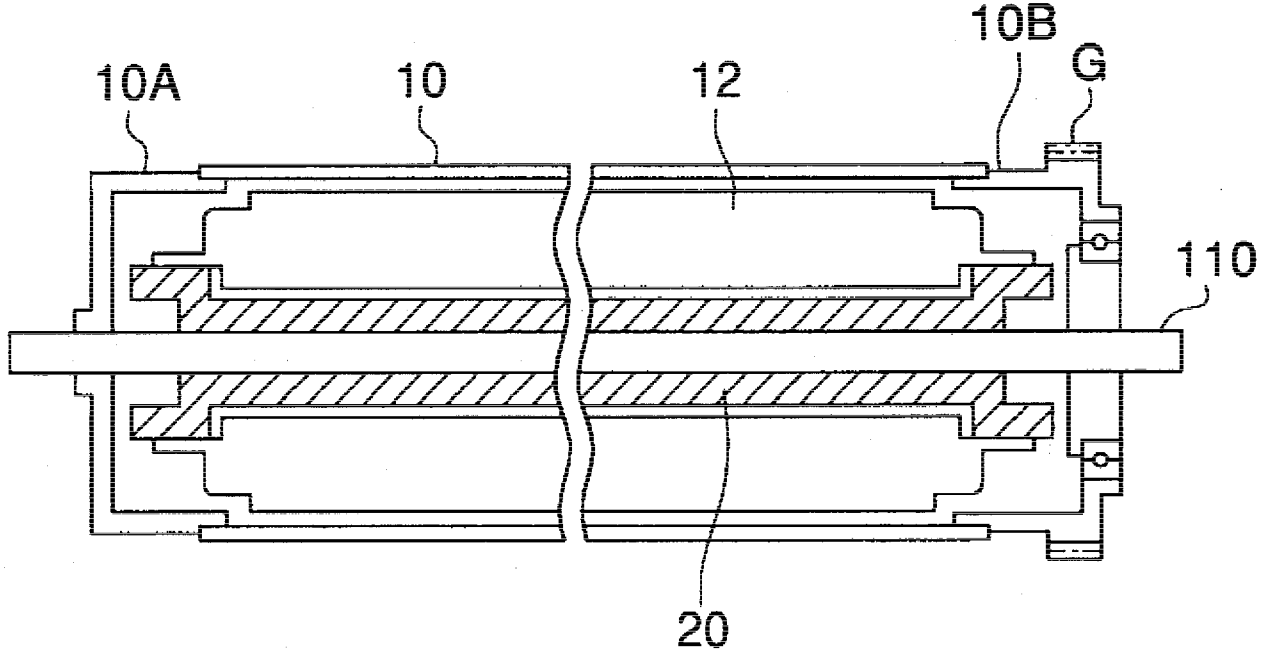
FIG. 2 is a cross-sectional view of a photoreceptor drum of the invention.

In the above-mentioned photoreceptor drum 10, as shown in FIG. 2, flange members 10A and 10B, which are arranged to the both edges of the drum surface so as to be fixedly coupled to the photoreceptor drum 10, are directly or indirectly pivoted on drum shaft 110 that is fixedly installed on the apparatus, so that the flange members can be supported to be freely rotatable, and gear G unified with flange member 10B into a body is engaged with a driving gear on the apparatus body side and is then driven, so that the photoreceptor drum 10 can be rotated in the specific direction.

In photoreceptor drum 10, the above-mentioned drum shaft 110 is fixed upon inserting support member 20 for setting up and fixing the foregoing optical exposure systems 12 into the drum 10, so that the drum shaft 110 can be unified and fixed the support member 20 into a body.

Figure 3:
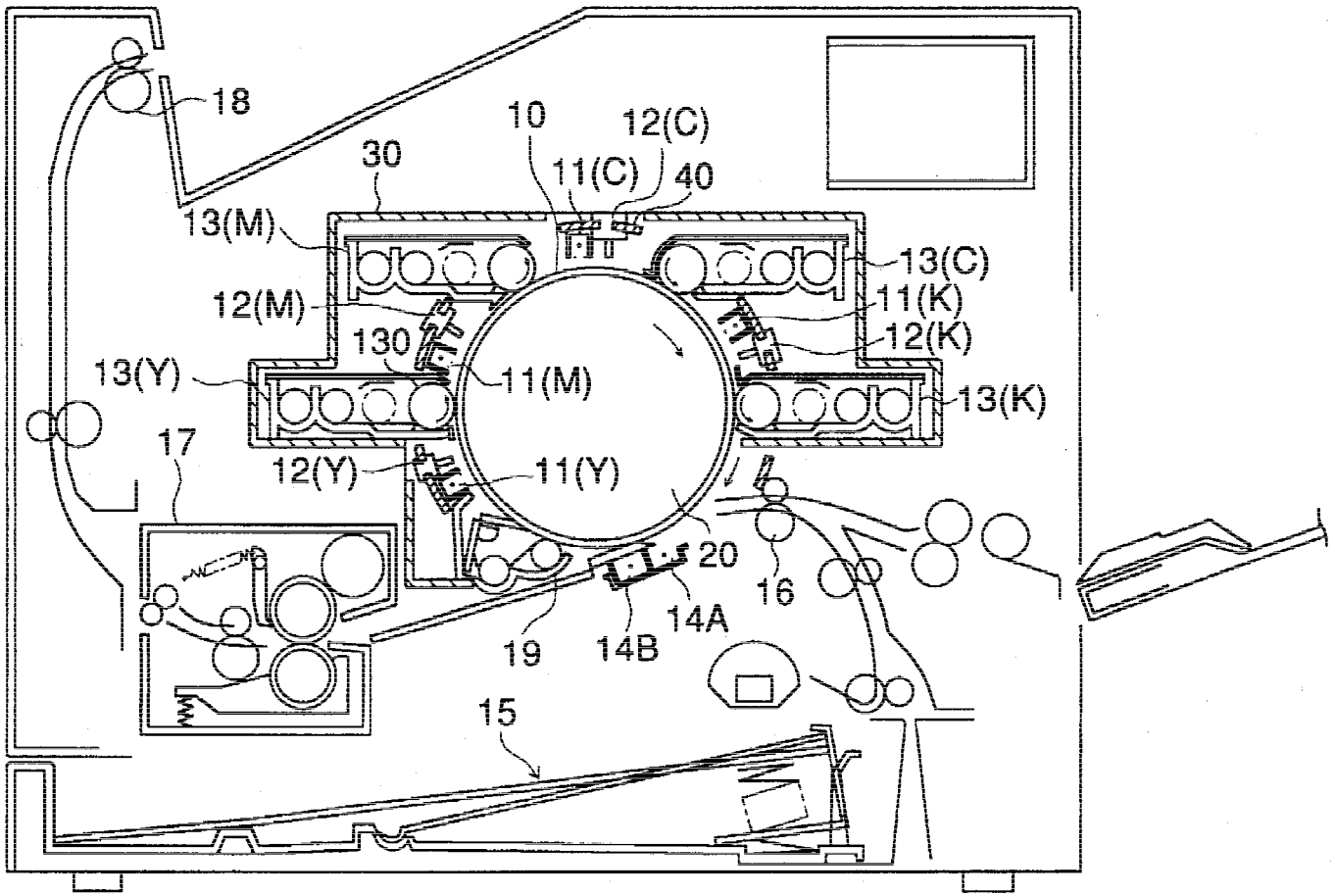
FIG. 3 is a cross-sectional structural view of another color image forming apparatus of the invention.

FIG. 3 shows a color image forming apparatus embodied in another example. There shows such a construction that optical exposure systems 12 are arranged to the outside of photoreceptor drum 10. The above-mentioned photoreceptor drum 10, as shown in FIG. 2 of which has previously been detailed, flange members 10A and 10B, which are arranged to the both edges of the drum surface so as to be fixedly coupled to the photoreceptor drum 10, are directly or indirectly pivoted on drum shaft 110 that is fixedly installed on the apparatus, so that the flange members can be supported to be freely rotatable, and gear G unified with flange member 10B into a body is engaged with a driving gear on the apparatus body side and is then driven, so that the photoreceptor drum 10 can be rotated in the specific direction.

Figure 4:
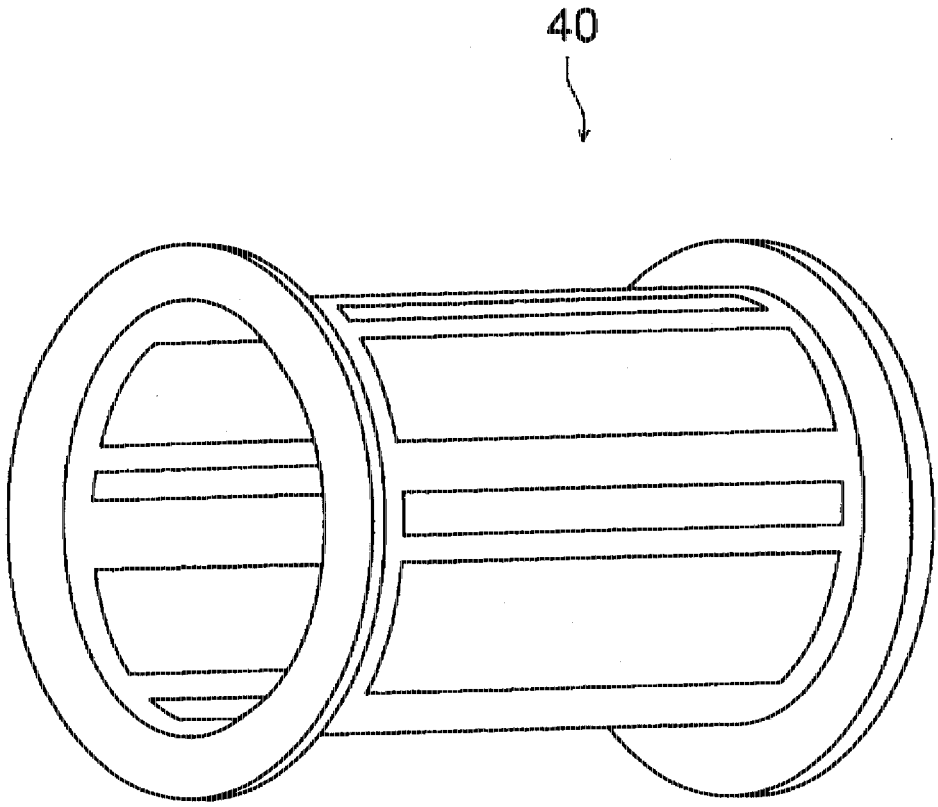
FIG. 4 is a Perspective view of a support member of the invention.

FIG. 4 shows a simple part of support member 40 supporting optical exposure systems 12 embodied in the example shown in FIG. 3. Wherein, support member 40 is a cylindrical member concentric with the photoreceptor drum, and support member 40 covers photoreceptor drum 10 from the outside. Optical exposure systems 12 are each fixed to the circumferential surface of support member 40. With support member 40 shown in FIG. 4, the open slits are so provided as to insert developing devices 13 and optical exposure systems 12, respectively.

Every one of the invention of which will be detailed below relates to the methods of fixedly setting up each optical exposure system 12 to the foregoing support member 20 or support member 40.

(EXAMPLE 1)

Figure 5:
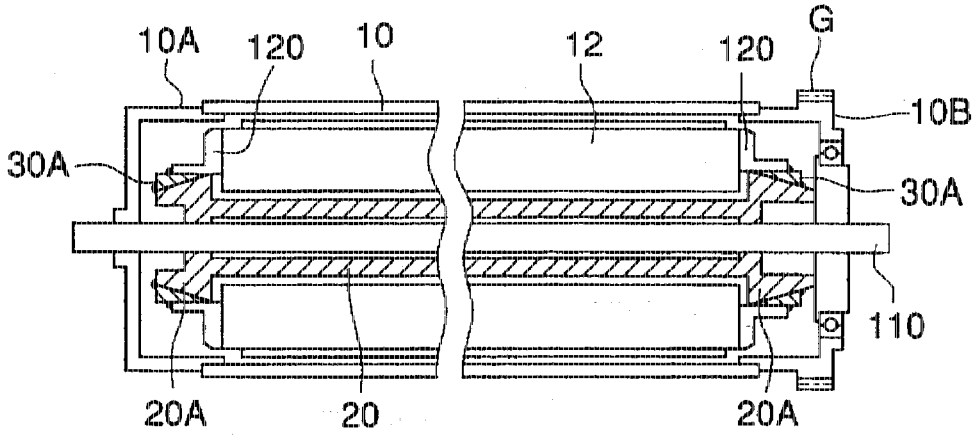
FIGS. 5(*a*)–5(*c*) is cross-sectional views each illustrating an example of attaching an internal exposure type imagewise exposure means according to Example 1.
Figure 5:
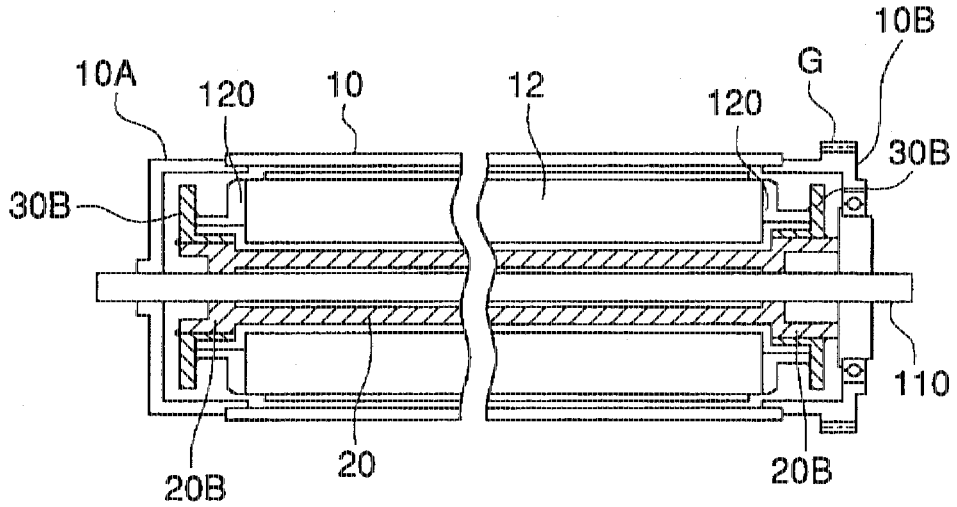
Figure 5:
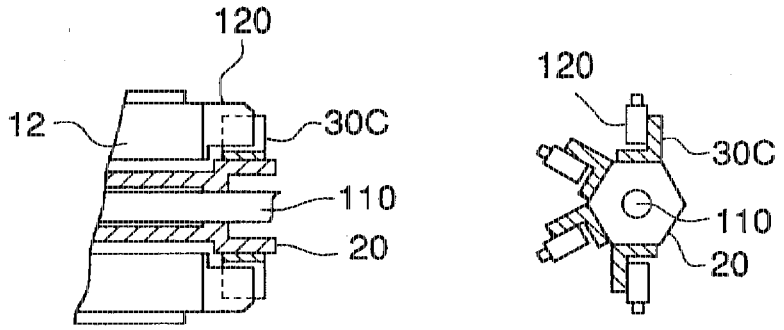
Figure 6:
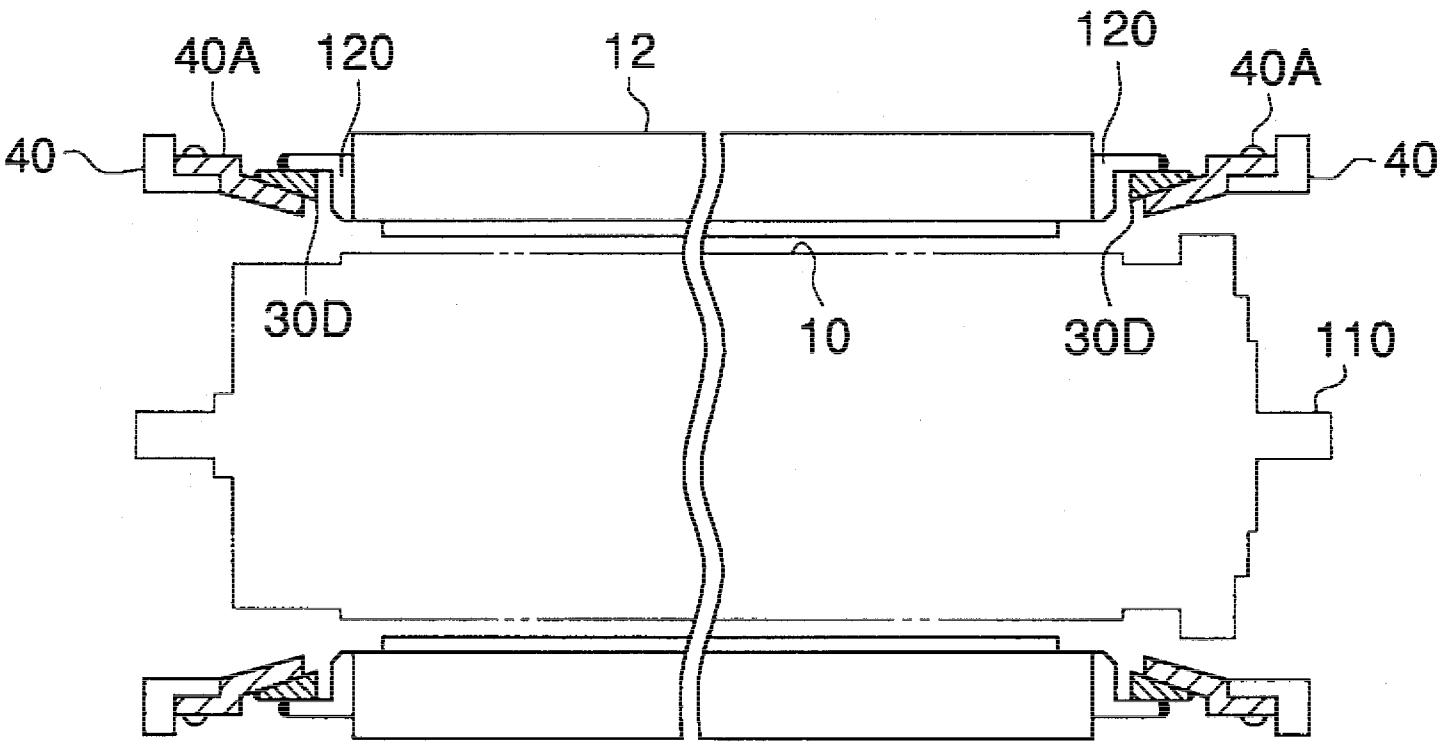
FIG. 6 is a cross-sectional view illustrating an example of attaching an external exposure type imagewise exposure means according to Example 1.
Figure 7:
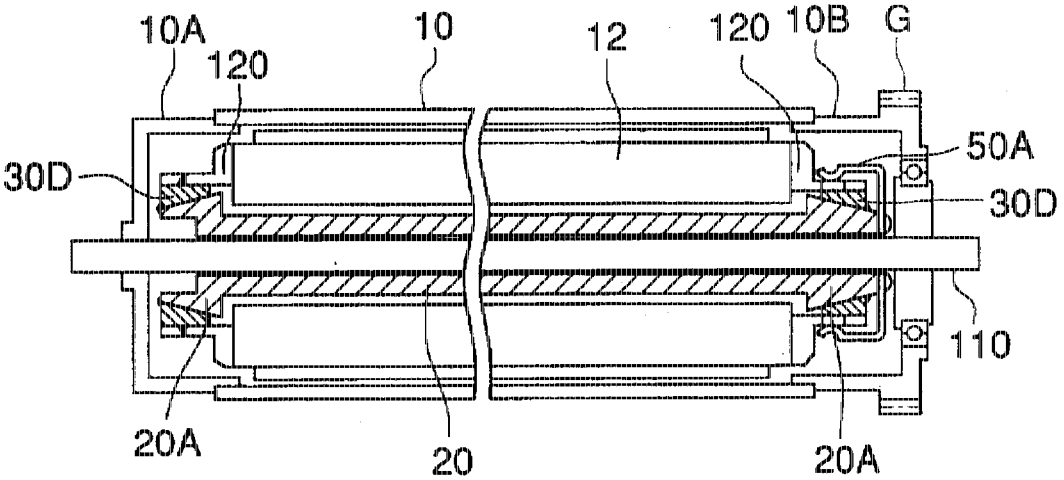
FIG. 7 is a cross-sectional view illustrating an example of attaching an internal exposure type imagewise exposure means according to Example 2.
Figure 8:
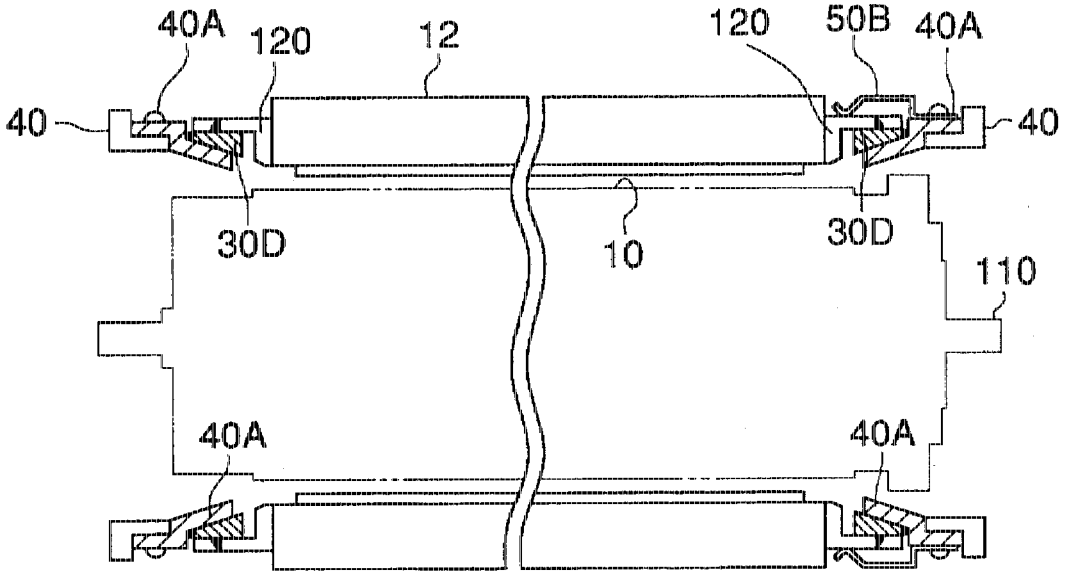
FIG. 8 is a cross-sectional view illustrating an example of attaching an external exposure type imagewise exposure means according to Example 2.
Figure 9:
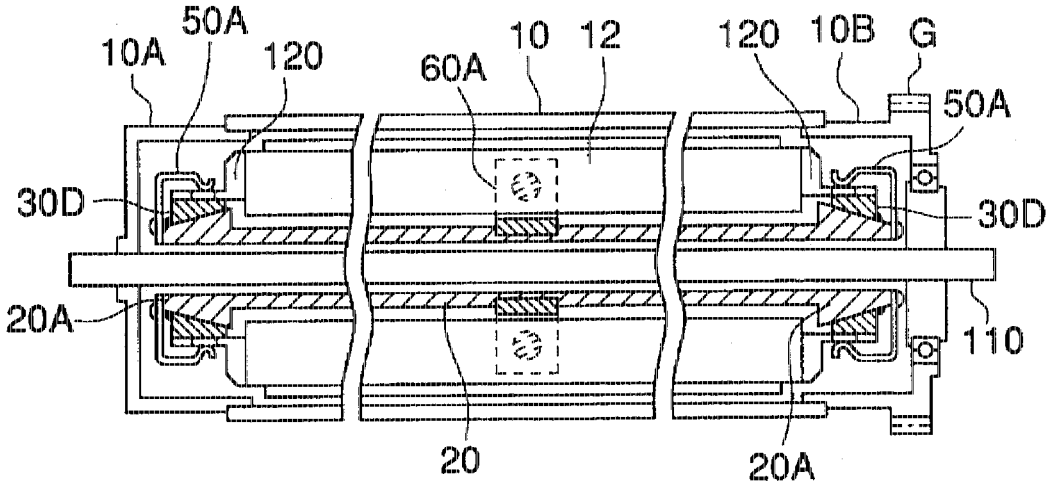
FIG. 9 is a cross-sectional view illustrating an example of attaching an internal exposure type imagewise exposure means according to Example 3.
Figure 12:
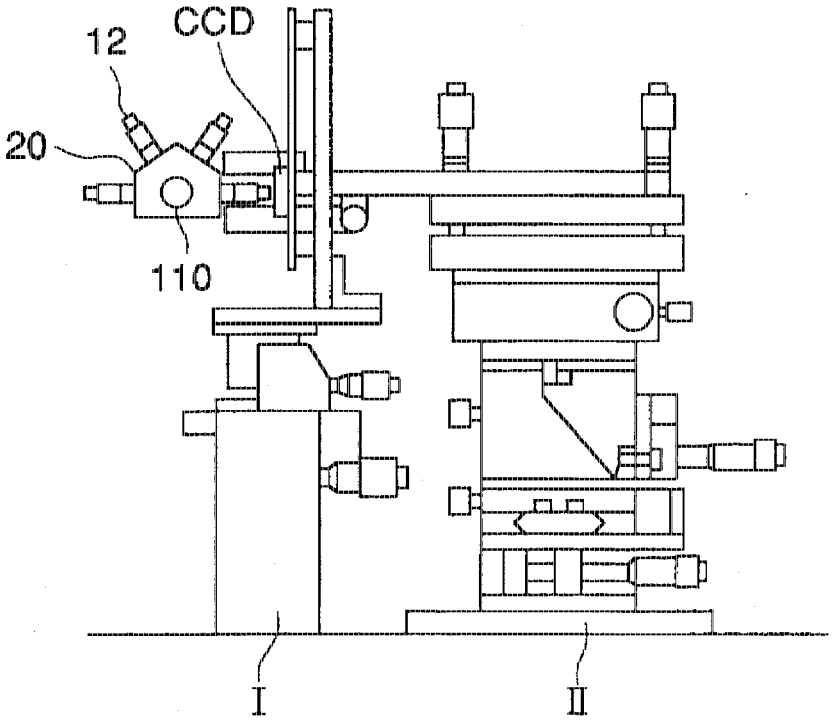
FIG. 12 is an explanatory drawing of an assembly jig.

Example 1 will be detailed with the citation of FIGS. 5, 6 and 12.

In the example shown in FIG. 5(*a*), the both ends of the above-mentioned support member 20 were each made to have a polygonal-shaped slant surfaces 20A, and wedge-shaped pasting members 30A were interposed between slant surfaces 20A and frame members 120 for supporting optical exposure system 12, respectively. The height and parallelism of optical exposure system 12 were adjusted by moving pasting members 30A in the axial direction, so that the position of optical exposure system could be so determined as to correspond to the photoreceptive surface on the circumference of photoreceptor drum 10.

In the example shown in FIG. 5(*b*), the both ends of the above-mentioned support member 20 were each made to have a cylindrical (or polygonal) surface 20B, and L-shaped pasting members 30B were interposed between cylindrical surfaces 20B and frame members 120 for supporting optical exposure system 12, respectively. The height and parallelism of optical exposure system 12 were adjusted by making the frame members 120 up and down by using pasting members 30B as the guide, so that the position of optical exposure system could be so determined as to correspond to the photoreceptive surface on the circumference of photoreceptor drum 10.

When the both ends of support member 20 had each a cylindrical surface, the surface of the foregoing pasting member 30B coming into contact with support member 20 was formed to have a curvature identical with that of the cylindrical surface of support member 20.

In each of the examples, pasting members 30A and 30B were each fixed at the ends thereof after adjusting the position of optical exposure system 12. As the example shown in FIG. 5(*c*), it is also allowed that the position of optical exposure system 12 can be determined in such a manner that the outside surface of frame member 120 of optical exposure system 12 is adjusted and fixed upon making the outside surface thereof up and down along the inside surface of L-shaped pasting member 30C.

In the case of an apparatus having optical exposure system 12 arranged to the outside of photoreceptor drum 10, as the example shown in FIG. 6, cylindrical member 40 was arranged to the outside of photoreceptor drum 10 so as to be concentric with each other, and optical exposure systems 12 were supported in such a state that they were inserted respectively into a plurality of slits elongated in the shaft direction on the circumferential surface of the foregoing cylindrical member 40, (See FIG. 4).

The foregoing cylindrical member 40 was fixed opposite to a pair of support members 40A having slant surfaces on both ends of each slit, and wedge-shaped pasting member 30D was interposed between the foregoing slant surface and frame member 120 of optical exposure system 12. The height and parallelism of optical exposure system 12 were adjusted by moving pasting members 30D in the axial direction, so that the position of optical exposure system 12 could be so determined as to correspond to the circumferential surface of photoreceptor drum 10.

Both ends each of optical exposure systems 12 thus positioned were directly fixed to the respective pasting member, and the pasting members were then fixed by an adhesive to the respective support members, so that optical exposure systems 12 were arranged opposite to the circumferential surface of photoreceptor drum 10.

(EXAMPLE 2)

Example 2 will be detailed with citation of FIGS. 7, 8, 11 and 12.

The both ends of the above-mentioned support member 23 were each made to have a polygonal-shaped slant surface 20A, and wedge-shaped pasting members 30D were interposed between slant surfaces 20A and frame members 120 for supporting optical exposure system 12, respectively. The height and parallelism of optical exposure system 12 were adjusted by moving pasting members 30D in the shaft direction, so that the position of optical exposure system 12 could be so determined as to correspond to the photoreceptive surface on the circumference of photoreceptor drum 10.

In the case of an apparatus having optical exposure system 12 arranged to the outside of photoreceptor drum 10, as the example shown in FIG. 5, cylindrical member 40 was arranged to the outside of photoreceptor drum 10 so as to be concentric with each other, and optical exposure systems 12 were supported in such a state where they were inserted respectively into a plurality of slits elongated in the shaft direction on the circumferential surface of the foregoing cylindrical member 40.

The foregoing cylindrical member 40 was fixed opposite to a pair of support members 40A having slant surfaces on both ends of each slit, and wedge-shaped pasting member 30D was interposed between the foregoing slant surface and frame member 120 of optical exposure system 12. The height and parallelism of optical exposure system 12 were adjusted by moving pasting members 30D in the shaft direction, so that the position of optical exposure system 12 could be so determined as to correspond to the circumferential surface of photoreceptor drum 10.

Figure 10:
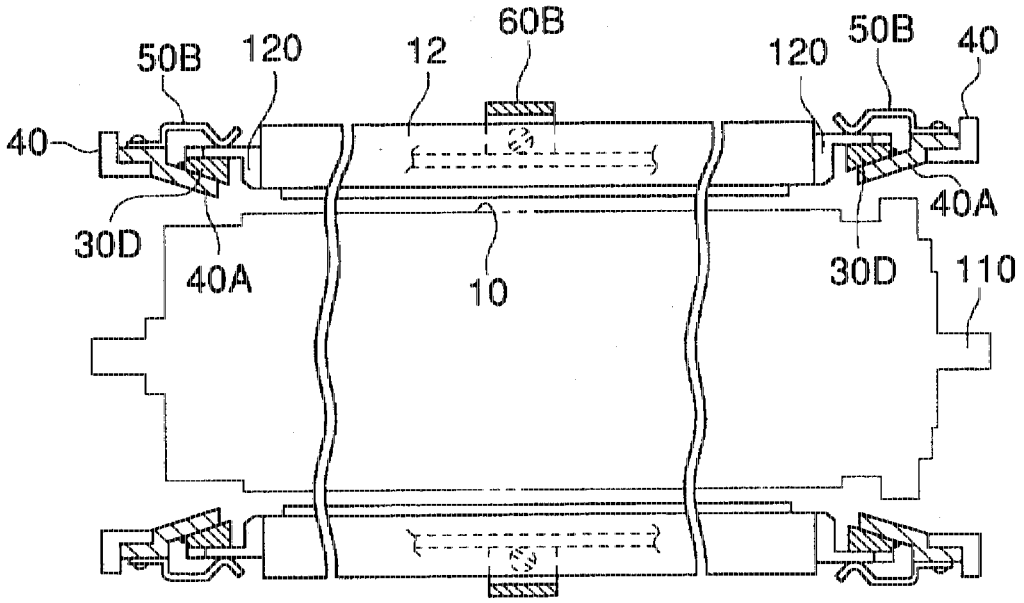
FIG. 10 is a cross-sectional view illustrating an exhale of attaching an external exposure type imagewise exposure means according to Example 3.

As shown in FIG. 10 illustrating the plan view and the substantial part of the above-mentioned each pasting member 30D, they served each as a guide member having a U-shaped cross-section. One end thereof was fixed to both optical exposure system 12 and support member 20 or 40A, and other end thereof was fixed only to the support member side. The side of optical exposure system 12 was supported in such a state that frame member 120 was slidably guided by bringing elastic member 50A or 50B into pressure contact with frame member 120.

Therefore, optical exposure system 12 was freely elastic even if it was expanded or shrunken by its own generation of heat or by any surrounding temperature change, because one end of the system was not fixed. Resultingly, the linearity and parallelism of the optical system were maintained so as to display the same elasticity as that of the fixed portion of the fixed optical system when making an imagewise exposure. Therefore, the registration accuracy of the optical system was maintained.

By making use of an elastic adhesive in place of the above-mentioned elastic member 50A or 50B so as to make optical exposure system 12 adhere to pasting member 30D, it was also allowed that the elasticity of optical exposure system 12 could be absorbed by the elasticity of the adhesive. It is suitable for this purpose to make use of hot-melt, silicon or a rubber type elastic adhesive, for example.

(EXAMPLE 3)

Example 3 will now be detailed with citation of FIGS. 9, 10, 11 and 12.

In the foregoing support member 20, the both ends thereof was each made to have a polyhedral-shaped slant surface 21)A, and U-shaped pasting member 60A having the opened top was fixed to the support member 20 in the center of the support member 20 in the shaft direction.

The center of optical exposure system 12 was sandwiched between the foregoing pasting members 60A so as to make the system up and down to adjust the height and parallelism of optical exposure system 12. Thereby the position of optical exposure system 12 was determined to correspond to the photoreceptive surface on the circumference of photoreceptor drum 10 and then the optical exposure system 12 was made adhered. After that, wedge-shaped pasting member 30D was interposed between frame members 120 for supporting optical exposure system 12 on the both ends and slant surface 20A of support member 20.

After moving the foregoing pasting member 30D in the shaft direction so as to secure optical exposure system 12 to be in the adjusted position, pasting member 30D was then adhesively fixed to support member 20 and, on the other hand, frame member 120 supporting pasting member 30D from the upper side was slidably held by bringing elastic member 50A into pressure contact with pasting member 30D.

In the case of an apparatus having optical exposure system 12 arranged to the outside of photoreceptor drum 10, as the example shown in FIG. 10, cylindrical member 40 was arranged to the outside of photoreceptor drum 10 so as to be concentric with each other, and optical exposure systems 12 were supported in such a state where they were inserted respectively into a plurality of slits elongated in the shaft direction on the circumferential surface of the foregoing cylindrical member 40.

In the foregoing cylindrical member 40, U-shaped pasting member 60B having openings toward each slit was fixed onto the circumferential surface in the shaft direction in the center of cylindrical member 40. Further, a pair of support members 40A having polygonal-shaped slant surface were fixed to the both ends of each slit so as to be opposite to each other. In such a state where optical exposure system 12 was sandwiched between the foregoing pasting members 60B, the height and parallelism of the exposure system were adjusted to determine the position thereof so as to be correspond to the photoreceptive surface of photoreceptor drum 10 and the exposure system was made adhered. After that, a wedge-shaped pasting member 30D was interposed between frame member 12C and the foregoing slant surface, so that the above-mentioned adjusted position was secured by moving the pasting member 30D in the shaft direction.

Figure 11:
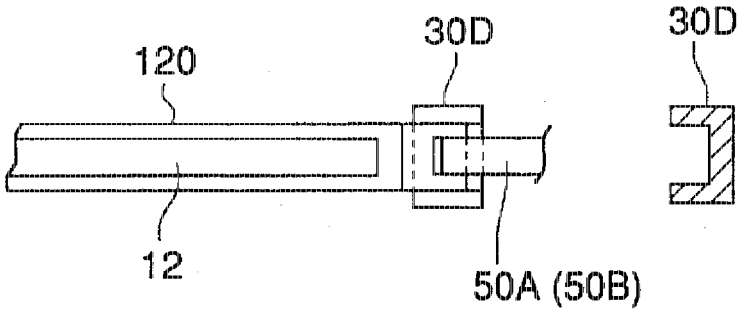
FIG. 11 is an explanatory drawing of a paste member.

As shown in FIG. 11 illustrating the plan view and the substantial part of the above-mentioned each pasting member 30D, they served each as a guide member having a U-shaped cross-section. The above-mentioned pasting members 30D held frame member 120 without play dimensionwise. They were fixed to support member 20 or 40A with an adhesive. In optical exposure system 12, however, frame member 120 was slidably, guided and held by bringing elastic member 50A or 50B into pressure contact with the system 12.

Therefore, optical exposure system 12 was freely elastic even if it was expanded or shrunken by its own generation of heat or by any surrounding temperature change, because both ends of the system were not fixed. Resultingly, the linearity and parallelism of the optical system were maintained so as to display the same elasticity as that of the center portion as the criteria. Therefore, the registration accuracy of the optical system was secured when making an imagewise exposure.

In each of the above-given examples, the position of optical exposure system 12 was determined by making use of a assembly jig comprising Stage I for supporting such a CCD as shown in FIG. 12 and Stage II for supporting optical exposure system 12 temporarily fixed to support member 20. The above-mentioned CCD was arranged to each position corresponding to the both ends of optical exposure system 12, and a support member and a pasting member, or a pasting member and one of optical exposure systems 12 are made adhered to be fixed, in such a state where the image pixels and/or image focuses are made consistent with each other by an optical system in the determined position. As for the adhesives, any ordinary setting type resin adhesives are applicable. Among them, a UV-setting type resin adhesive may preferably be used. From the viewpoints of making an assembly easier and improving the accuracy, it is preferred that, after the position was adjusted by making use of the foregoing assembly jigs in advance of setting an adhesive, the adhesive was set by applying UV rays so as to make it in a fixed state.

(EXAMPLE 4)

Figure 13:
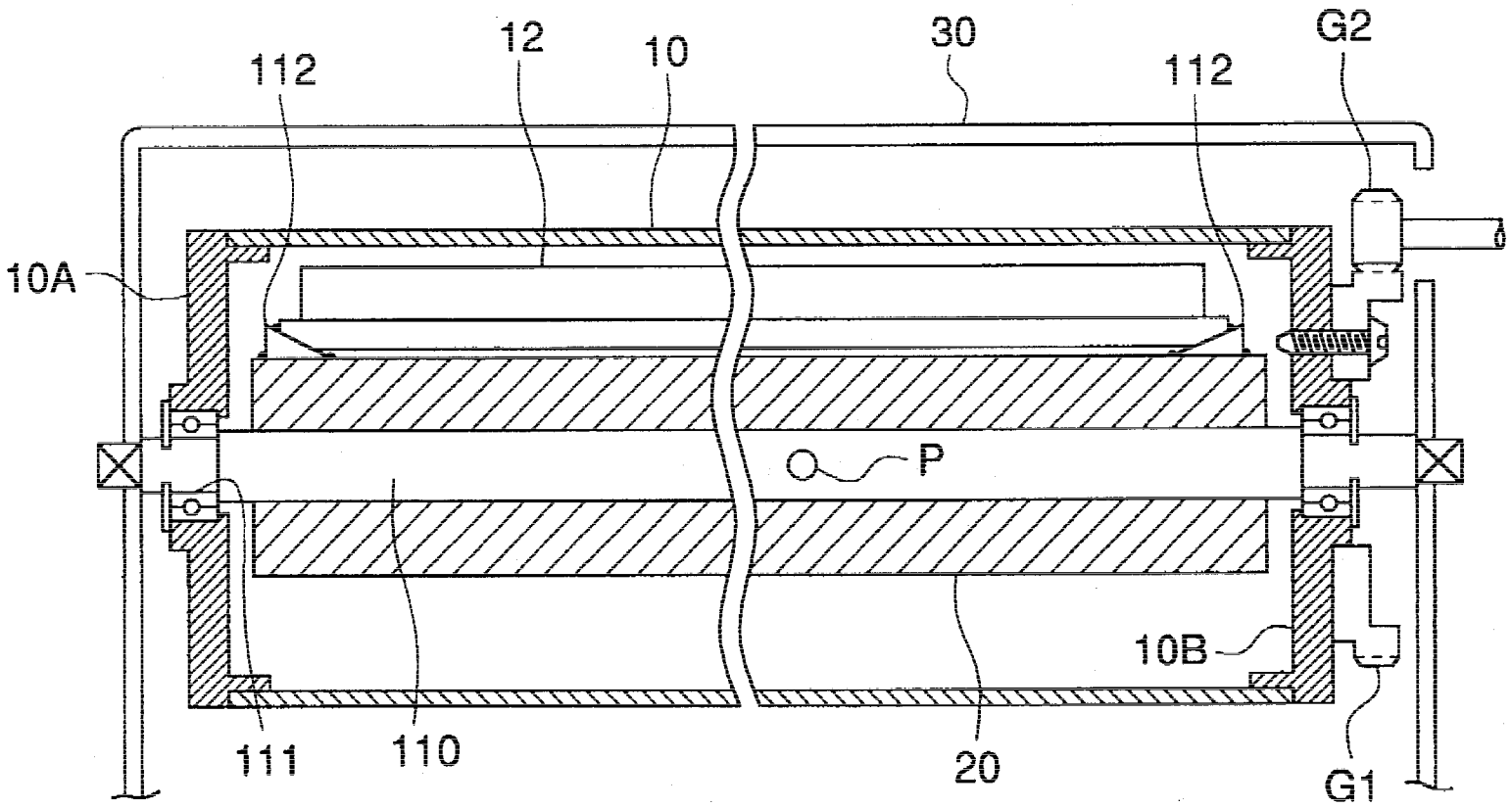
FIG. 13 is a cross-sectional structural view illustrating a photoreceptor and an imagewise exposure means built therein, according to Example 4.
Figure 14:
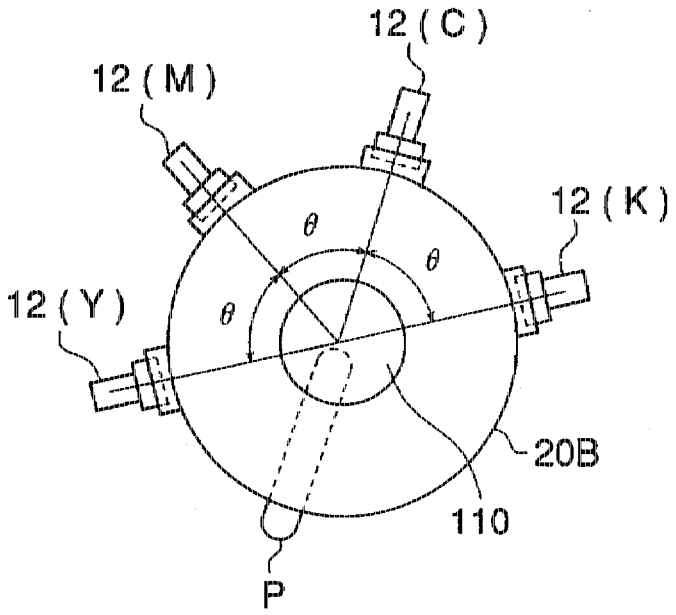
FIG. 14(*a*)–14(*b*) is a cross-sectional view illustrating the arrangement of an imagewise exposure means to a support member, according to Example 4.
Figure 14:
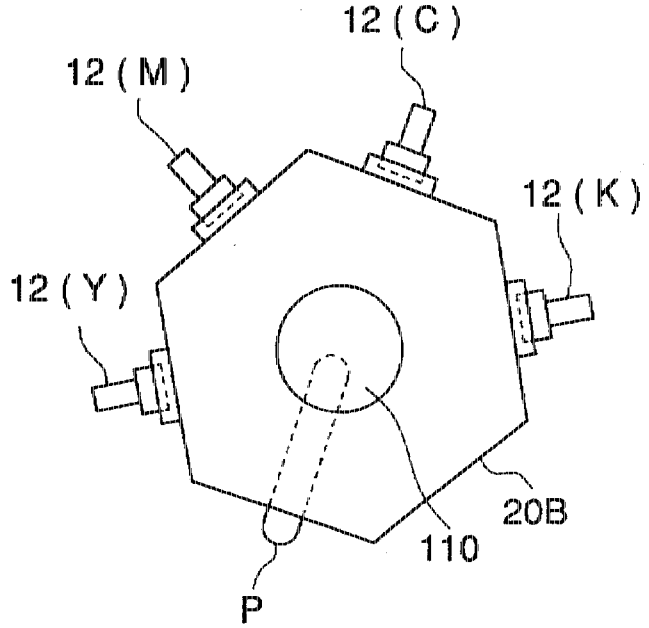

Example 4 will now be detailed with citation of FIGS. 13, 14(*a*) and 14(*b*).

In photoreceptor drum 10, the above-mentioned drum shaft 110 was fixed by a fitting means such as knock-pin P so as to be united into a body, upon inserting support member 20A or 20B having such a cylindrical or equilateral polygonal cross-section as shown in FIG. 14(*a*) or 14(*b*).

In each of the above-mentioned support members 20A and 20B, the outer circumferential surface thereof had a substantially high straightness so as to constantly keep the distance from the photoreceptive surface, i.e., the circumferential surface of the drum, extended over the shaft direction. It is also allowed that each of the above-mentioned support members may be formed so that they may be united with the foregoing drum shaft 110 into a body.

To support member 20A, each of the above-mentioned optical exposure systems 12 was so attached in a row as to have the same intervals of angle θ in the circumferential direction of support member 20A. To support member 20B, on the other hand, each of the optical exposure systems was so attached in a row to the center of each polygonal surface of support member 20B and, in other words, each of them was attached to the support members resultingly in a row with the same intervals.

For attaching each of optical exposure systems 12 to support member 20A or 20B, a pair of wedge-shaped pasting members 112 were used as shown in FIG. 2.

Upon making adjustment of the height of the end of the optical system from the shaft center of drum shaft 110 by moving optical exposure system 12 with the jigs to the shaft direction in the loaded state, the above-mentioned pasting members 112 were fixed by applying an adhesive, preferably a UV-setting type resin adhesive between the basal part of optical system and the support members including the foregoing pasting members 112. With pasting member 112 applicable to support member 20A, the surface thereof adhered to the support member 20A was so curved as to come into close contact with the outer circumferential surface of the support member 20A.

It can readily and accurately be performed to set the positions of each optical exposure system 12 by the individual adjustment of the optical systems so as to correspond to the photoreceptive surface of photoreceptor drum 10 and, at the same time, any registration change produced by a thermal expansion can also be avoided by the arrangements with the same intervals.

In short, when making the arrangements with the same intervals, the positions of the optical systems and/or the photoreceptor may be varied isotropically by a thermal expansion. In other words, even if the intervals of each exposure position should be varied, the variations can characteristically be maintained to be the same. To be more concrete, it was constituted that any registration change produced by a thermal expansion can be avoided if the angular velocity of the photoreceptor is constantly controlled.

(EXAMPLE 5)

Figure 15:
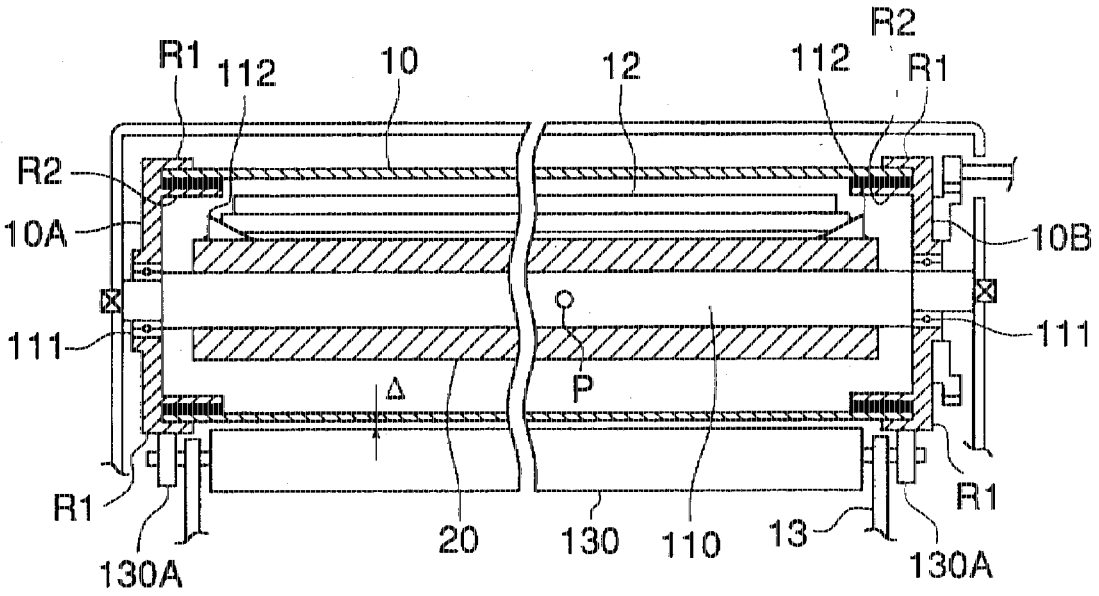
FIG. 15(*a*)–15(*b*) is a drawing of the substantial part illustrating the positional relation between an imagewise exposure means and a developing means, according to Example 5.
Figure 15:
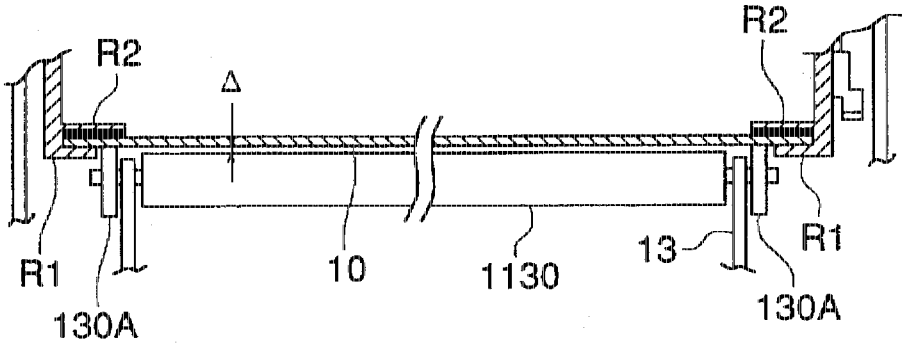

Example 5 will now be detailed with the citation of FIGS. 15(*a*) and 15(*b*).

Generally, the outer circumferential surface of photoreceptor drum 10 is highly accurate, because the high accuracy thereof can be maintained by shaving the substratum thereof. However, a satisfactory accuracy of the inner circumferential surface thereof can hardly be maintained, because the inner surface is technically difficult to be shaved. In photoreceptor drum 10, the foregoing drum shaft 110 was fixed by a fitting member such as knock-pin P so as to be united into a body, upon inserting a cylindrical-shaped support member 20 into drum 10 in such a state where the drum shaft 110 was fitted in the inner bore of the support member 20, as shown in FIG. 15(*a*).

The foregoing support member 20 has a high roundness of both inside and outside diameter so as to constantly keep the distance between the outer circumferential surface of the support member 20 and the photoreceptive surface of photoreceptor drum 10, i.e., the circumferential surface of the drum, extending over the shaft direction.

Each of the foregoing optical exposure systems 12 was adhesively fixed with an adhesive including preferably a UV-setting type resin adhesive, upon adjusting accurately the height from the center of drum shaft 110 by moving a pair of wedge-shaped pasting members 112 to the direction of the shaft of support member 20.

On the other hand, on the outer circumferences of the foregoing flange members 10A and 10B each for supporting the both ends of photoreceptor drum 10, both of concentric inner and outer rings R1 and R2 were formed. The outer circumferential surface of photoreceptor drum 10 was fitted in the inner circumferential surface of outer ring R1 and an adhesive was filled in a gap produced between the outer circumferential surface of inner ring R2 and the inner surface of the drum so as to be united into a body.

Therefore, the distance from the center of drum shaft. 110, i.e., from the center of the bearing of flange members 10A and 10B, to the photoreceptive surface arranged onto the transparent substratum of photoreceptor drum 10 was accurately determined only by the processing accuracy of flange members 10A and 10B without being influenced by scattering or variations of the thickness of the drum. Resultingly, an accurate focusing point determination can be realized in the combination of the aforementioned distance and the height adjustment of optical exposure systems 12.

Figure 16:
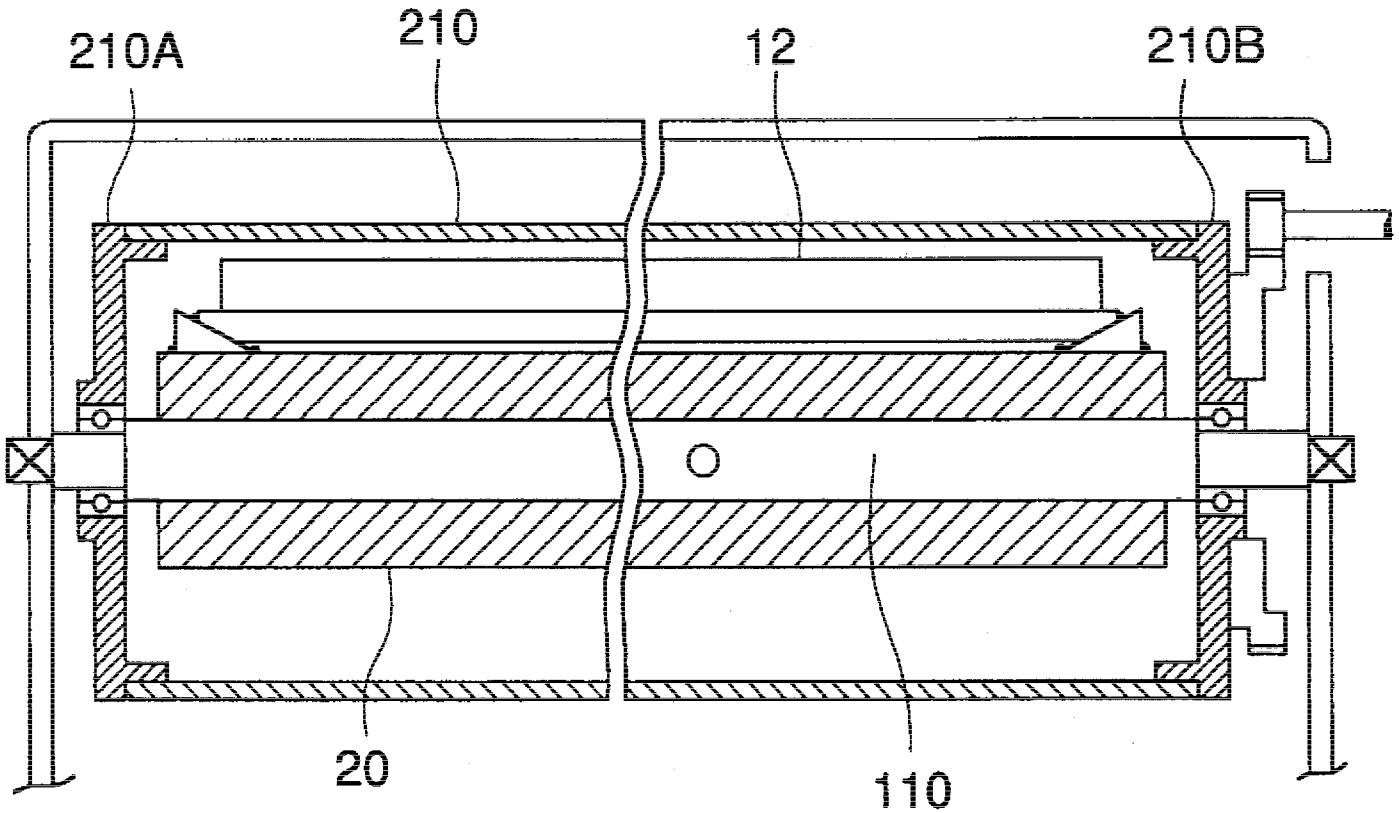
FIG. 16 is a cross-sectional view showing a positioning method of an optical system in which the inner circumferential surface of the photoreceptor is the reference to the positioning.

Incidentally, FIG. 16 shows the case that photoreceptor drum 210 was attached to flange members 210A and 210B on the basis of the inner circumferential surface of drum 210 as the reference. Therefore, the distance from the photoreceptive surface, i.e., the outer circumferential surface to the center of drum shaft 110 cannot constantly be kept by a scattering or variations of the thickness of photoreceptor drum 210 and, therefore, the accuracy lowering of the focus point of optical exposure system 12 cannot be avoided.

Further, according to the invention, the position of developing sleeve 130 of each developing device 13 can also be determined to correspond to the photoreceptive surface of photoreceptor drum 10 in such a manner that a roller supported on the same axis of developing sleeve 130 so provided as to keep a specific gap, i.e., a bumper roller 130A, was so arranged as to come into close contact with the outer circumferential surface of each outer ring R1 of flange members 10A and 10B as shown in FIG. 15(*a*), or in such a manner that bumper roller 130A can be brought directly into close contact with the circumferential surface of the drum that was attached to inner ring R2 as shown in FIG. 15(*b*); and, therefore, a development Gap between a photoreceptive surface and developing sleeve 130 can accurately be determined without including any unstable factors. Resultingly, in a color image forming apparatus of the invention for carrying out a non-contact development, the above-mentioned Gap (i.e., a developing Gap) can constantly be maintained so that the development of a Good quality image having a stable density can be realized.

Also according to the invention, it is possible to set a plurality of imagewise exposure means to a highly accurate focus point on a photoreceptor and to eliminate any troubles produced by a temperature change, so that the registration functions can further be kept up. Resultingly, a color image forming apparatus capable of forming a high-quality image having a high sharpness without accompanying any color doubling extending over a long time can be provided.

Further in the invention, a focus point of the optical system of a built-in type imagewise exposure means can be determined with a high accuracy on the photoreceptive surface on the transparent substratum of a drum-shaped photoreceptor, so that any registration variations of an imagewise exposure can be eliminated and an accurate development gap between the photoreceptive surface and a developing sleeve can also be determined. Resultingly, a color image forming apparatus capable of recording a high-quality color image having an excellent image quality such as sharpness and color tones as well as a stable color density can be provided.

What is claimed is:

1. A color image forming apparatus comprising:

a photoreceptor for holding a multicolor toner image thereon;

a charging device for charging said photoreceptor;

a plurality of imagewise exposure devices each for imagewisely exposing said photoreceptor, which is charged by said charging device, with light so as to form a latent image corresponding to a component image of said multicolor toner image on said photoreceptor;

a support member for supporting said plurality of imagewise exposure devices so that said plurality of imagewise exposure devices are fixed on said support member at positions where said light from each of said plurality of imagewise exposure devices is focused on said photoreceptor;

a plurality of developing devices each for developing said latent image with one of a plurality of color toners so as to form said component image of said multicolor toner image on said photoreceptor; and a transfer device for transferring said multicolor toner image from said photoreceptor to a transfer member;

wherein charging of said charging device, exposing of said plurality of imagewise exposure devices, and developing of said plurality of developing devices are performed to form said multicolor toner image on said photoreceptor while said photoreceptor is rotated one time; and wherein each of said plurality of imagewise exposure devices is fixed onto a predetermined position of said support member by an adhesive.

2. The apparatus of claim 1, wherein said adhesive comprises a UV-setting type resin adhesive.

3. The apparatus of claim 1, wherein each of said plurality of imagewise exposure devices is fixed onto said support member through an adjustable pasting member by said adhesive.

4. The apparatus of claim 2, wherein said adjustable pasting member is fixed at an end of each of said plurality of imagewise exposure devices.

5. The apparatus of claim 2, wherein said adjustable pasting member is fixed at a side of each of said plurality of imagewise exposure devices.

6. A color image forming apparatus comprising:

a photoreceptor for holding a multicolor toner image thereon;

a charging device for charging said photoreceptor;

a plurality of imagewise exposure devices each for imagewisely exposing said photoreceptor, which is charged by said charging device, with light so as to form a latent image corresponding to a component image of said multicolor toner image on said photoreceptor;

a support member for supporting said plurality of imagewise exposure devices so that said plurality of imagewise exposure devices are fixed on said support member at positions where said light from each of said plurality of imagewise exposure devices is focused on said photoreceptor;

a plurality of developing devices each for developing said latent image with one of a plurality of color toners so as to form said component image of said multicolor toner image on said photoreceptor; and a transfer device for transferring said multicolor toner image from said photoreceptor to a transfer member;

wherein charging of said charging device, exposing of said plurality of imagewise exposure devices, and developing of said plurality of developing devices are performed to form said multicolor toner image on said photoreceptor while said photoreceptor is rotated one time; and wherein one end of each of said plurality of imagewise exposure devices is fixed on said support member, and another end of each of said plurality of imagewise exposure devices is in an unfixed state.

7. The apparatus of claim 6, wherein one end of each of said plurality of imagewise exposure devices is supported elastically in an unfixed state by a guide member.

8. The apparatus of claim 6, wherein one end of each of said plurality of imagewise exposure devices is supported elastically in an unfixed state by an adhesive.

9. A color image forming apparatus comprising:

a photoreceptor for holding a multicolor toner image thereon;

a charging device for charging said photoreceptor;

a plurality of imagewise exposure devices each for imagewisely exposing said photoreceptor, which is charged by said charging device, with light so as to form a latent image corresponding to a component image of said multicolor toner image on said photoreceptor;

a support member for supporting said plurality of imagewise exposure devices so that said plurality of imagewise exposure devices are fixed on said support member at positions where said light from each of said plurality of imagewise exposure devices is focused on said photoreceptor;

a plurality of developing devices each for developing said latent image with one of a plurality of color toners so as to form said component image of said multicolor toner image on said photoreceptor; and a transfer device for transferring said multicolor toner image from said photoreceptor to a transfer member;

wherein charging of said charging device, exposing of said plurality of imagewise exposure devices, and developing of said plurality of developing devices are performed to form said multicolor toner image on said photoreceptor while said photoreceptor is rotated one time; and wherein a center of each of said plurality of imagewise exposure devices is fixed on said support member, and each end of each of said plurality of imagewise exposure devices is in an unfixed state.

10. The apparatus of claim 9, wherein each end of each of said plurality of imagewise exposure devices is supported elastically in an unfixed state by a guide member.

11. A color image forming apparatus comprising:

a photoreceptor for holding a multicolor toner image thereon;

a charging device for charging said photoreceptor;

a plurality of imagewise exposure devices each for imagewisely exposing said photoreceptor, which is charged by said charging device, with light so as to form a latent image corresponding to a component image of said multicolor toner image on said photoreceptor;

a support member for supporting said plurality of imagewise exposure devices so that said plurality of imagewise exposure devices are fixed on said support member at positions where said light from each of said plurality of imagewise exposure devices is focused on said photoreceptor;

a plurality of developing devices each for developing said latent image with one of a plurality of color toners so as to form said component image of said multicolor toner image on said photoreceptor;

a transfer device for transferring said multicolor toner image from said photoreceptor to a transfer member;

a pair of flanges, attached to side ends of said photoreceptor, each for supporting a side end of said photoreceptor; and a plurality of position restriction devices each for restricting a position of each of said plurality of developing devices;

wherein charging of said charging device, exposing of said plurality of imagewise exposure devices, and developing of said plurality of developing devices are performed to form said multicolor toner image on said photoreceptor while said photoreceptor is rotated one time;

wherein said imagewise exposure devices are arranged on said support member so that said plurality of imagewise exposure devices are fixed on said support member at positions where said light from each of said plurality of imagewise exposure devices is focused on an outer circumferential surface of said photoreceptor; and wherein each of said plurality of position restriction devices restricts said position of each of said plurality of developing devices in relation to an outer circumferential surface of said pair of flange.

12. A color image forming apparatus comprising:

a photoreceptor for holding a multicolor toner image thereon;

a charging device for charging said photoreceptor;

a plurality of imagewise exposure devices each for imagewisely exposing said photoreceptor, which is charged by said charging device, with light so as to form a latent image corresponding to a component image of said multicolor toner image on said photoreceptor;

a support member for supporting said plurality of imagewise exposure devices so that said plurality of imagewise exposure devices are fixed on said support member at positions where said light from each of said plurality of imagewise exposure devices is focused on said photoreceptor;

a plurality of developing devices each for developing said latent image with one of a plurality of color toners so as to form said component image of said multicolor toner image on said photoreceptor;

a transfer device for transferring said multicolor toner image from said photoreceptor to a transfer member;

a pair of flanges, attached to side ends of said photoreceptor, each for supporting a side end of said photoreceptor; and a plurality of position restriction devices each for restricting a position of each of said plurality of developing devices;

wherein charging of said charging device, exposing of said plurality of imagewise exposure devices, and developing of said plurality of developing devices are performed to form said multicolor toner image on said photoreceptor while said photoreceptor is rotated one time;

wherein said imagewise exposure devices are arranged on said support member so that said plurality of imagewise exposure devices are fixed on said support member at positions where said light from each of said plurality of imagewise exposure devices is focused on an outer circumferential surface of said photoreceptor; and wherein each of said plurality of position restriction devices restricts said position of each of said plurality of developing devices in relation to said outer circumferential surface of said photoreceptor.

13. A color image forming apparatus comprising:

a photoreceptor for holding a multicolor toner image thereon;

a charging device for charging said photoreceptor;

a plurality of imagewise exposure devices each for imagewisely exposing said photoreceptor, which is charged by said charging device, with light so as to form a latent image corresponding to a component image of said multicolor toner image on said photoreceptor;

a support member for supporting said plurality of image exposure devices so that said plurality of imagewise exposure devices are fixed on said support member at positions where said light from each of said plurality of imagewise exposure devices is focused on said photoreceptor;

a plurality of developing devices each for developing said latent image with one of a plurality of color toners so as to form said component image of said multicolor toner image on said photoreceptor; and a transfer device for transferring said multicolor toner image from said photoreceptor to a transfer member;

wherein charging of said charging device, exposing of said plurality of imagewise exposure devices, and developing of said plurality of developing devices are performed to form said multicolor toner image on said photoreceptor while said photoreceptor is rotated one time; and wherein each of said plurality of imagewise exposure devices is fixed onto said support member through an adjustable pasting member by an adhesive.

14. A color image forming apparatus comprising:

a photoreceptor for holding a multicolor toner image thereon;

a charging device for charging said photoreceptor;

a plurality of imagewise exposure devices each for imagewisely exposing said photoreceptor, which is charged by said charging device, with light so as to form a latent image corresponding to a component image of said multicolor toner image on said photoreceptor;

a support member for supporting said plurality of imagewise exposure devices so that said plurality of imagewise exposure devices are fixed on said support member at positions where said light from each of said plurality of imagewise exposure devices is focused on said photoreceptor;

a plurality of developing devices each for developing said latent image with one of a plurality of color toners so as to form said component image of said multicolor toner image on said photoreceptor; and a transfer device for transferring said multicolor toner image from said photoreceptor to a transfer member;

wherein charging of said charging device, exposing of said plurality of imagewise exposure devices, and developing of said plurality of developing devices are performed to form said multicolor toner image on said photoreceptor while said photoreceptor is rotated one time; and wherein said photoreceptor has a drum shaped body which rotates around an axis, and said support member is concentric with the axis and is symmetrically shaped with respect to the axis.

15. The apparatus of claim 14, wherein said support member is cylindrically shaped and covers an outside portion of said photoreceptor.

16. The apparatus of claim 14, wherein said support member has a cylindrically-shaped surface on which said plurality imagewise exposure devices are supported.

17. The apparatus of claim 16, wherein said support member and said imagewise exposure devices are disposed in an inside portion of said photoreceptor.

18. The apparatus of claim 14, wherein said support member has a polygonally-shaped surface on which said plurality of imagewise exposure devices are supported.

19. The apparatus of claim 18, wherein said support member and said imagewise exposure devices are disposed in an inside portion of said photoreceptor.

* * * * *